US007263965B2

(12) United States Patent
Bloomquist

(10) Patent No.: US 7,263,965 B2
(45) Date of Patent: Sep. 4, 2007

(54) FLOATING CRANK SHAFT

(76) Inventor: Victor Rudolph Bloomquist, 13718 NE. 182 Ave., Brush Prairie, WA (US) 98606

( * ) Notice: Subject to any disclaimer, the term of this patent is extended or adjusted under 35 U.S.C. 154(b) by 0 days.

(21) Appl. No.: 10/406,102

(22) Filed: Apr. 4, 2003

(65) Prior Publication Data

US 2004/0194752 A1 Oct. 7, 2004

(51) Int. Cl.
*F02B 75/32* (2006.01)

(52) U.S. Cl. ..... 123/197.1; 123/197.4

(58) Field of Classification Search ..... 123/197.1, 123/197.4

See application file for complete search history.

(56) References Cited

U.S. PATENT DOCUMENTS 5,836,273 A * 11/1998 Hair ..... 123/197.4
6,564,762 B2 * 5/2003 Dow ..... 123/197.4

* cited by examiner

*Primary Examiner*—Noah P. Kamen

(57) ABSTRACT

An engine with two crank shafts. One crank shaft stationary or secured to the block by conventional main bearings. The other crank shaft is referred to as the floating crank moves in a radius back and forth along one side of the stationary crank.

Figure 1:
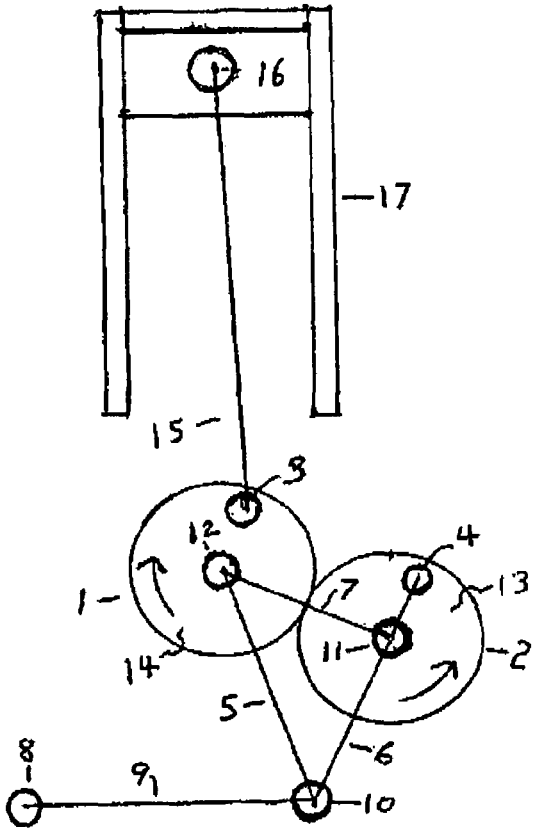
Figure 2:
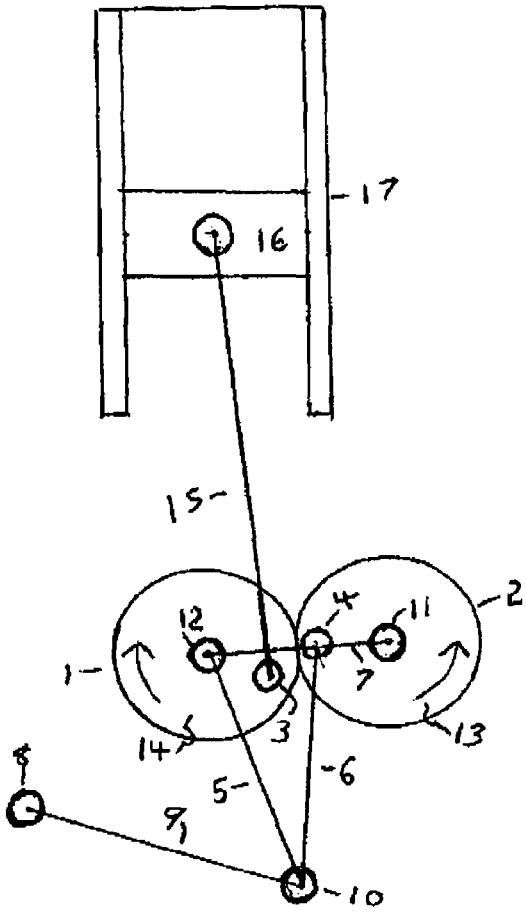
Figure 3:
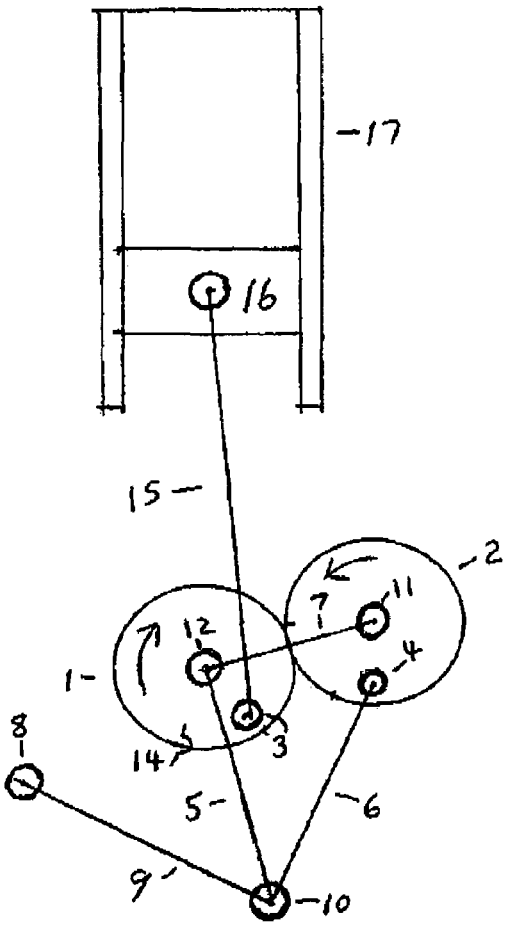
Figure 4:
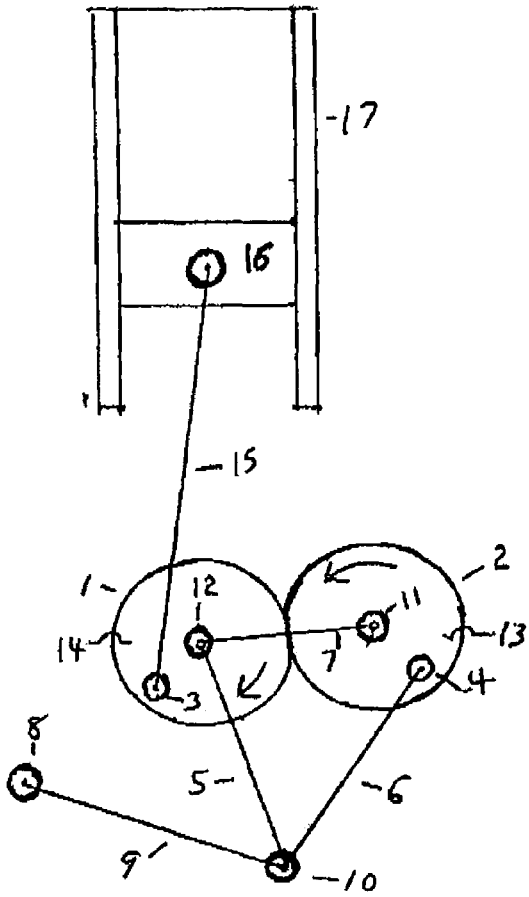

The cranks drive each other by being geared together. A conventional piston and con rod are attached to the floating crank and drive the floating crank in both rotating and downward motions. Both of the motions rotate the stationary crank shaft.

Each piston has its own floating crank shaft separate from the other pistons. The crank shafts rotate in opposite directions. The floating crank shaft operated in position by two radius rods connected between the two crank shafts, two rods from the floating crank shaft to the stabilizer rod and control rod. All of the four rods are pinned together where they meet. The other end of the control rod is connected to the stationary crank journal. The other end of the stabilizer rod is anchored in the engine block by a pivot pin.

3 Claims, 3 Drawing Sheets

The first four drawings are viewed from the end of the crank shafts

The first four drawings are viewed from the end of the crank shafts

Fig. 5

Picture 5 side view
In pictures 5 and 6 part numbers are on the parts
Numbers and parts are listed below

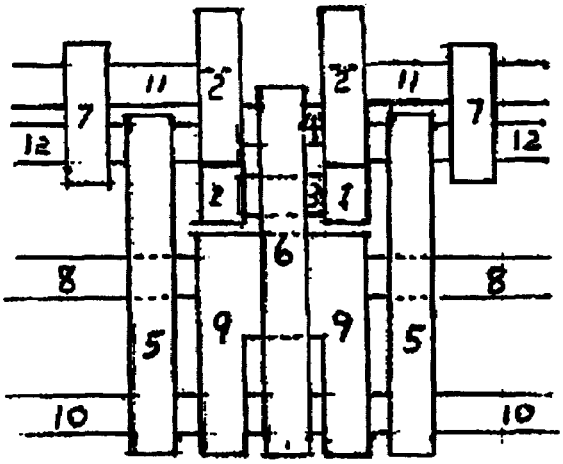

Picture 6 top view

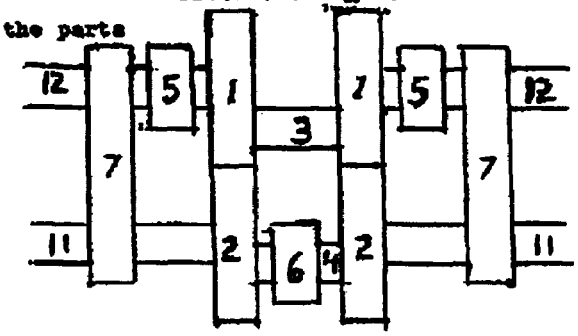

Fig. 6

1 Floating crank gears (two of those)
2 Stationary crank gears (two of those)
3 Floating crank piston rod journal
4 Stationary crank connecting rod journal
5 Floating crank connecting rods (two of those)
6 Stationary crank control connecting rod
7 Radious connecting rods (two of those)
8 Anchor pin on stabelizer connecting rod
9 Stabelizer connecting rod
10 Connecting pin where the three connecting rods meet
11 Stationary crank center shaft
12 Floating crank center shaft
13 Stationary crank
14 Floating crank
15 Piston connecting rod
16 Piston
17 Cylinder

FLOATING CRANK SHAFT

BACKGROUND OF THE INVENTION

The purpose of this engine is to hold the combusting fuel mixture in the cylinder for a longer period of time. The longer period of time being defined by the length of the power stroke compared to the driven crank shaft diameter. This engine has approximately a 16 percent longer power stroke per crank shaft diameter than a conventional engine. The longer the burning expanding fuel mixture can be held in the combustion changer, pushing on the piston, the more economical the engine will be. Another purpose of this engine is to present a better torque advantage. This is done by keeping the thrust power more to the outside circumference of the crank shaft than the conventional engine. The floating crank shaft is positioned on the outer circle of the driven stationary crank shaft. This position is in a way that should produce more torque per pound of push from the power stroke of the piston.

BRIEF SUMMARY

The floating crank shaft has some innate advantages over the conventional crank shaft engine. One advantage is the piston is at 15 degrees past top dead center at firing position without loss of piston height. Another advantage is the push force is held more to a longer radius on the stationary crank, long radius meaning 90 degrees to the top dead center line. This longer radius is held for a longer period of travel on the power stroke. The above described advantage should produce more efficiency per pound of fuel burned. The 15 degrees past top dead center can be increased or decreased by re-timing the crank shaft gears one to the other. Re-timing the gears will also change the torque characteristics of the power stroke.

BRIEF DESCRIPTION OF THE INVENTION

FIG. 1

The drawing is a view from the rear of the crank shafts. It shows the floating crank piston rod journal 3 fifteen degrees past top dead center with the piston in top position.

FIG. 2

The drawing is a view from the rear of the crank shafts. It shows the piston approximately 60 percent through the power stroke. It shows journal 3 approximately one-third the length of the radius of the driven stationary crank 13 farther out from center shaft 11 than the radius length of stationary crank 13. This is a one-third better torque position than a conventional engine has.

FIG. 3

The drawing is a view from the rear of the crank shafts. It shows the position of the two crank shafts at the end of the power stroke.

FIG. 4

The drawing is a view from the rear of the crank shafts. It shows the position of the crank shafts as the piston is being pushed back up.

FIG. 5

It is a side view of the crank shafts and rods.

FIG. 6

It is a top view of the crank shafts and rods.

DETAILED DESCRIPTION OF THE INVENTION

This description will use the numbers on the parts shown in the drawings to identify what is being described. The floating crank shaft consisting of two identical gears, 1 and 1, connected by the con rod journal 3, in a rigid manner, just inside the gear teeth. The journal 3 is at a 90-degree angle to the flat side of the gears 1 and 1. The floating crank shaft journals 11 and 12 are on gears 1 and 1 at the center axis on the outside of the gears 1 and 1. Outside meaning the opposite side to con rod journal 3 which is between gears 1 and 1. Connection rod 15 is connected to con rod journal 3 and to piston 16. Piston 16 moves up and down in cylinder 17 and applies power on to journal 3 in the conventional way. The floating crank shaft 14 is attached to the stationary crank shaft 13 by two radius connection rods 7 and 7. Rods 7 and 7 are attached at the two floating crank shaft center shafts 12 and 12 and the two stationary crank shaft center shafts 11 and 11. The radious rods 7 and 7 keep the floating crank gears 1 and 1 the correct distance from the stationary crank gears 2 and 2. This keeps proper gear tooth contact between the four gears 1 and 2 and 1 and 2 as the floating crank shaft 14 moves up and down along side of the stationary crank 13. The up and down travel of the floating crank shaft 14 is controlled by the stationary crank control connecting rod 6, connected to floating crank connecting rods 5 and 5, at stabilizer connecting rod anchor pin 10. The floating crank 14 moves up and down the same distance as the diameter of the circle that journal 4 travels in. The stationary crank connecting rod journal 4 connects, and holds in place, the stationary crank gears 2 and 2 at a 90-degree position to the inside flat side of gears 2 and 2. The stationary crank 13 is secured in the engine block by stationary bearings on two stationary crank center shafts 11 and 11. The two shafts 11 and 11 are on outside of the two gears 2 and 2. The bottom of rod 6 and rods 5 and 5 are held in place by stabilizer connecting rod 9 by pin 10 with the other end of the stabilizer connecting rod anchored in the engine block by pin 8. The firing position is shown in picture 1 with rod journal 3 approximately 15 degrees after top dead center with the piston not losing elevation. This is accomplished because the stationary crank control connecting rod journal 4 is timed 60 degrees behind the floating crank piston rod journal 3. The floating crank journal 3 is still rising as it passes top dead center and on until approximately 15 degrees past top dead center. This rise happens because control rod 6 is still being pulled up on the return up side on the stationary crank 13; this continues on until journal 4 is approximately 22 degrees before top dead center on the stationary crank 13. The control rod 6 is connected to the floating crank connecting rods 5 and 5 at connecting pin 10; with this connection, control 6 raises, lowers, and controls the elevation of the floating crank 14 at all times. From 338 degrees to 360 degrees on the stationary crank journal 4, the control rod 6 has almost no up and down motion; this puts all the torque from floating crank gears 1 and 1 on to the stationary crank gears 2 and 2. As the crank journal 4 moves past top dead center, the control rod 6, which is under down pressure from the floating crank connecting rods 5 and 5, helps to pull the stationary crank 13 through the power cycle. The power stroke has two drive forces on the stationary crank 13. One is applied by the gears 1 and 1 onto the gears 2 and 2. The other force is applied by the control rod 6 pulling down on the rod journal 4. The down on rod 6 comes from the power stroke putting down force on the floating crank shaft 14, which in turn puts down force on connecting rods 5 and 5, which in turn puts down force on rod 6 at connecting pin 10.

The invention claimed is:

1. An engine crankshaft drive apparatus comprising:

a stabilizer rod having one end rotatably mounted on a pin on an engine block and the other end rotatably connected to an end of a stationary crank control rod and an end of a floating crank rod by a pin, the other end of the floating rod rotatably connected to a floating crankshaft at a crank center shaft, the floating crankshaft including a con rod journal on which an end of a connecting rod is mounted and wherein the other end of the connecting rod is adapted to be attached to a piston, the other end of the stationary crank control rod is connected to a stationary crank control connecting rod journal, and a radius connecting rod having one end mounted on the floating crank center shaft and the other mounted on the stationary crank center shaft.

2. The drive apparatus of claim 1 further comprising:

crank gears on the floating crankshaft meshing with crank gears on the stationary crankshaft.

3. The drive apparatus of claim 1 further comprising:

a pair of the following elements symmetrically arranged on either side of the stationary crank control connecting rod: floating crank gears, stationary crank gears, floating crank connecting rods, and radius connecting rods.

* * * * *